US005570564A

United States Patent [19]

Moore et al.

[11] Patent Number: 5,570,564

[45] Date of Patent: Nov. 5, 1996

[54] STRETCH WRAPPING APPARATUS WITH FILM ROLL SUPPORT

[75] Inventors: Phil Moore, Mount Washington; Patrick R. Lancaster, III, Louisville, both of Ky.

[73] Assignee: Lantech, Inc., Louisville, Ky.

[21] Appl. No.: 267,905

[22] Filed: Jul. 6, 1994

[51] Int. Cl.[6] ..... B65B 41/00

[52] U.S. Cl. ..... 53/389.2; 53/556; 242/571.4; 242/579

[58] Field of Search ..... 53/556, 389.2, 53/389.3; 242/571.4, 571.5, 578, 579, 590, 597.7, 559.4, 588, 600, 554.3, 565, 566

[56] References Cited

U.S. PATENT DOCUMENTS

| | | | |
|---|---|---|---|
| 2,419,798 | 4/1947 | Stone | 242/571.5 |
| 2,562,923 | 8/1951 | Koliuoski | 242/571.5 |
| 3,292,874 | 12/1966 | Tinkham | 242/571.5 |
| 3,793,798 | 2/1974 | Lancaster, III et al. | 53/30 |
| 4,050,221 | 9/1977 | Lancaster, III et al. | 53/211 |
| 4,255,918 | 3/1981 | Lancaster, III et al. | 53/556 |
| 4,458,467 | 7/1984 | Shulman et al. | 53/556 |
| 4,690,345 | 9/1987 | Cotey | 242/597.7 |
| 4,722,170 | 2/1988 | Ball et al. | 53/556 |
| 5,161,349 | 11/1992 | Lancaster et al. | 53/399 |

*Primary Examiner*—John Sipos
*Assistant Examiner*—Ed Tolan
*Attorney, Agent, or Firm*—Finnegan, Henderson, Farabow, Garrett & Dunner, L.L.P.

[57] ABSTRACT

A stretch wrap dispenser includes a support for a roll of stretch wrap packaging material and a core which permits the roll to rotate. The support has an indexing portion with an outer radial area for contacting and indexing one axial end of the stretch wrap packaging material at a predetermined axial position. It also has an inner radial area for permitting any portion of the core that extends beyond the one axial end of the stretch wrap packaging material to extend beyond the predetermined axial position. Relative rotation is provided between dispenser and the load to wrap the stretched sheet around the load.

28 Claims, 4 Drawing Sheets

STRETCH WRAPPING APPARATUS WITH FILM ROLL SUPPORT

BACKGROUND OF THE INVENTION

The invention relates to a stretch wrapping apparatus with a film roll support. Stretch wrapping apparatus have been used to wrap a load with a sheet of stretch wrap packaging material such as a film web. The sheet is usually dispensed from a roll having two axial ends and an axially extending core having two axial ends. An example of such a stretch wrapping apparatus is shown in U.S. Pat. No. 5,161,349, which is incorporated herein by reference. Such apparatus traditionally mount the film roll core on a shaft or between two core inserts. These mountings permit the roll to rotate while being restrained by a braking device which applies an appropriate amount of tension on the film web extending between the roll and the load, or between the roll and at least one downstream roller which stretches the film before it is wrapped on the load.

SUMMARY OF THE INVENTION

According to the invention, an apparatus is provided for stretch wrapping a load with a sheet of stretch wrap packaging material. The stretch wrap packaging material is dispensed from an axially extending roll of stretch wrap packaging material having two axial ends and an axially extended core having two axial ends. The apparatus includes a dispenser for dispensing and stretching the sheet of stretch wrap packaging material. The dispenser includes a support for the roll of stretch wrap packaging material and core which permits the roll to rotate. The support has an indexing portion with an outer radial area for contacting and indexing one axial end of the stretch wrap packaging material at a predetermined axial position and an inner radial area for permitting any portion of the core that extends beyond the one axial end of the roll of stretch wrap packaging material to extend beyond the predetermined axial position. The apparatus also includes means for providing relative rotation between the dispenser and the load to wrap the stretched sheet around the load.

The support preferably includes a retaining portion extending inside the core for preventing axial movement of the core relative to the support when the stretch wrap packaging material on the roll is radially inward of the outer radial area of the indexing portion. The retaining portion also preferably prevents angular movement of the core relative to the support.

BRIEF DESCRIPTION OF THE DRAWINGS

The accompanying drawings, which are incorporated in and constitute a part of the specification, illustrate presently preferred embodiments of the invention and, together with the general description given above, and the detailed description of the preferred embodiments given below, serve to explain the principles of he invention.

DETAILED DESCRIPTION OF THE PREFERRED EMBODIMENTS

Reference will now be made in detail to the present preferred embodiments of the invention as illustrated in the accompanying drawings.

Figure 1:
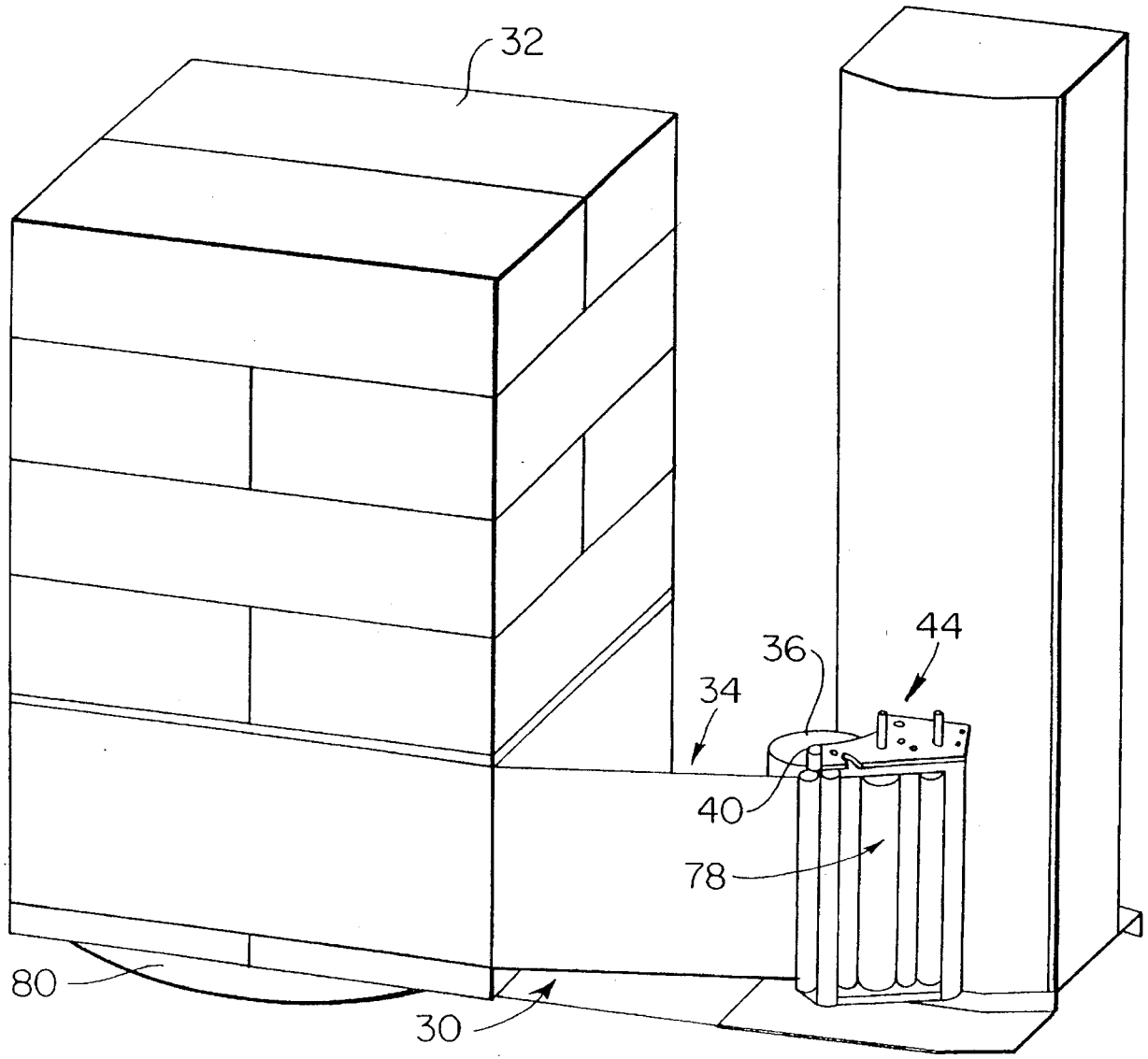
FIG. 1 is a perspective view of a stretch wrapping apparatus which includes the teaching of the present invention.

As shown in FIG. 1, a stretch wrapping apparatus 30 is provided for stretch wrapping a load 32 with a sheet 34 of stretch wrap packaging material. The sheet 34 is dispensed from a roll 36 of stretch wrap packaging material 38, such as a film web, wrapped about a core 40, such as a stiff cardboard cylinder. A dispenser 44 is provided to dispense and stretch the sheet 34 of stretch wrap packaging material 38. A prestretch mechanism 78 may be mounted in the dispenser 44 to stretch the sheet. Alternatively, the film roll can be braked. The dispenser 44 includes a support 46 for the roll 36 of stretch wrap packaging material 38 and the core 40 which permits the roll and core to rotate.

Means are used to provide relative rotation between the dispenser 44 and the load 32 to wrap the stretched sheet 34 around the load. Such means for providing relative rotation may include a motor driven turntable 80 which rotates the load. Alternatively, it may include an arm or ring or similar device which revolves the dispenser 44 around the load 32. Examples of such arrangements are shown in U.S. Pat. No. 5,161,349, which is incorporated herein by reference.

Figure 4:
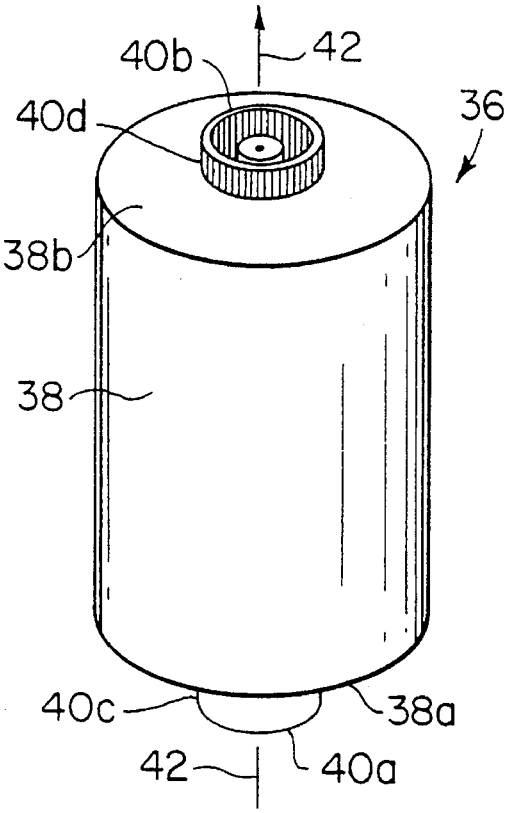
FIG. 4 is a perspective view of a roll of stretch wrap package material.

As shown in FIG. 4, the stretch wrap packaging material 38 on the roll 36 extends axially in the direction of a principal axis 42 and has two axial ends 38*a* and 38*b*. The core 40 extends axially along the principal axis 42 and has two axial ends 40*a* and 40*b*. A portion 40*c* of the core 40 extends beyond one axial end 38*a* of the roll 36 of stretch wrap packaging material 38. Similarly, another portion 40*d* of the core 40 extends beyond the other axial end 38*b* of the roll 36 of stretch wrap packaging material 38.

Figure 2:
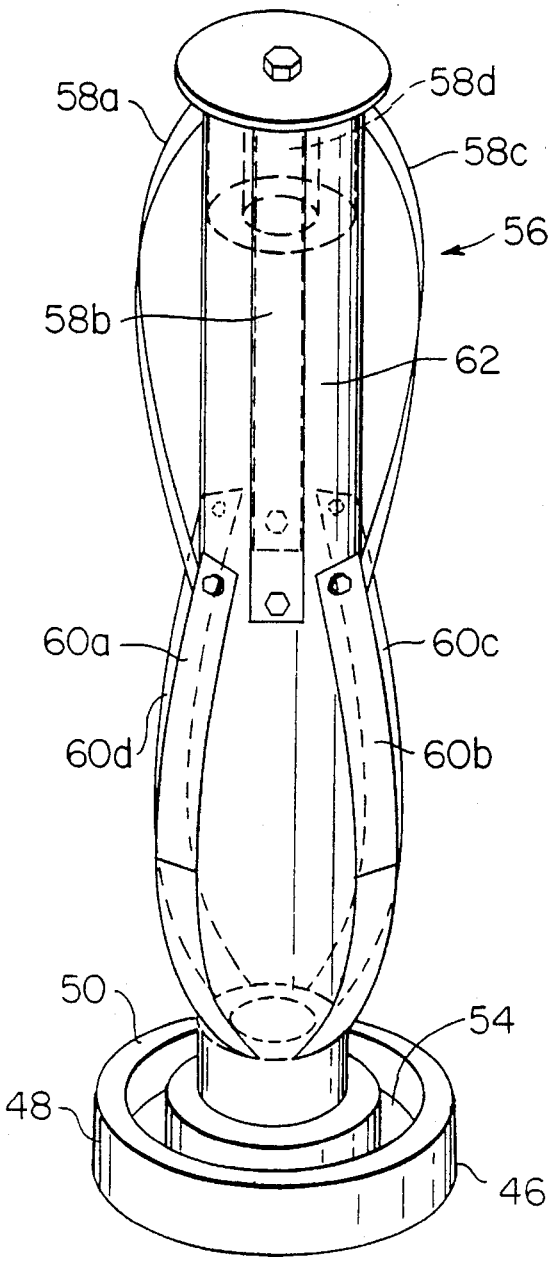
FIG. 2 is a perspective view of the support for the roll of stretch wrap packaging material shown in FIG. 1.
Figure 3:
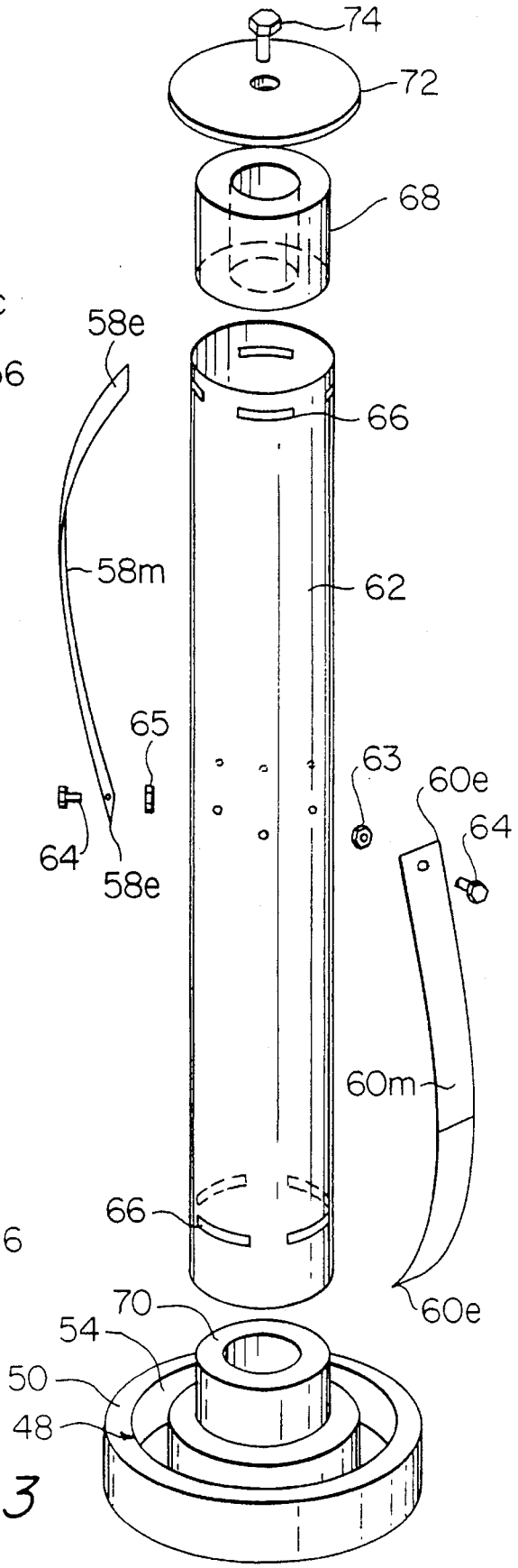
FIG. 3 is an exploded view of the support shown in FIG. 2.
Figure 8:
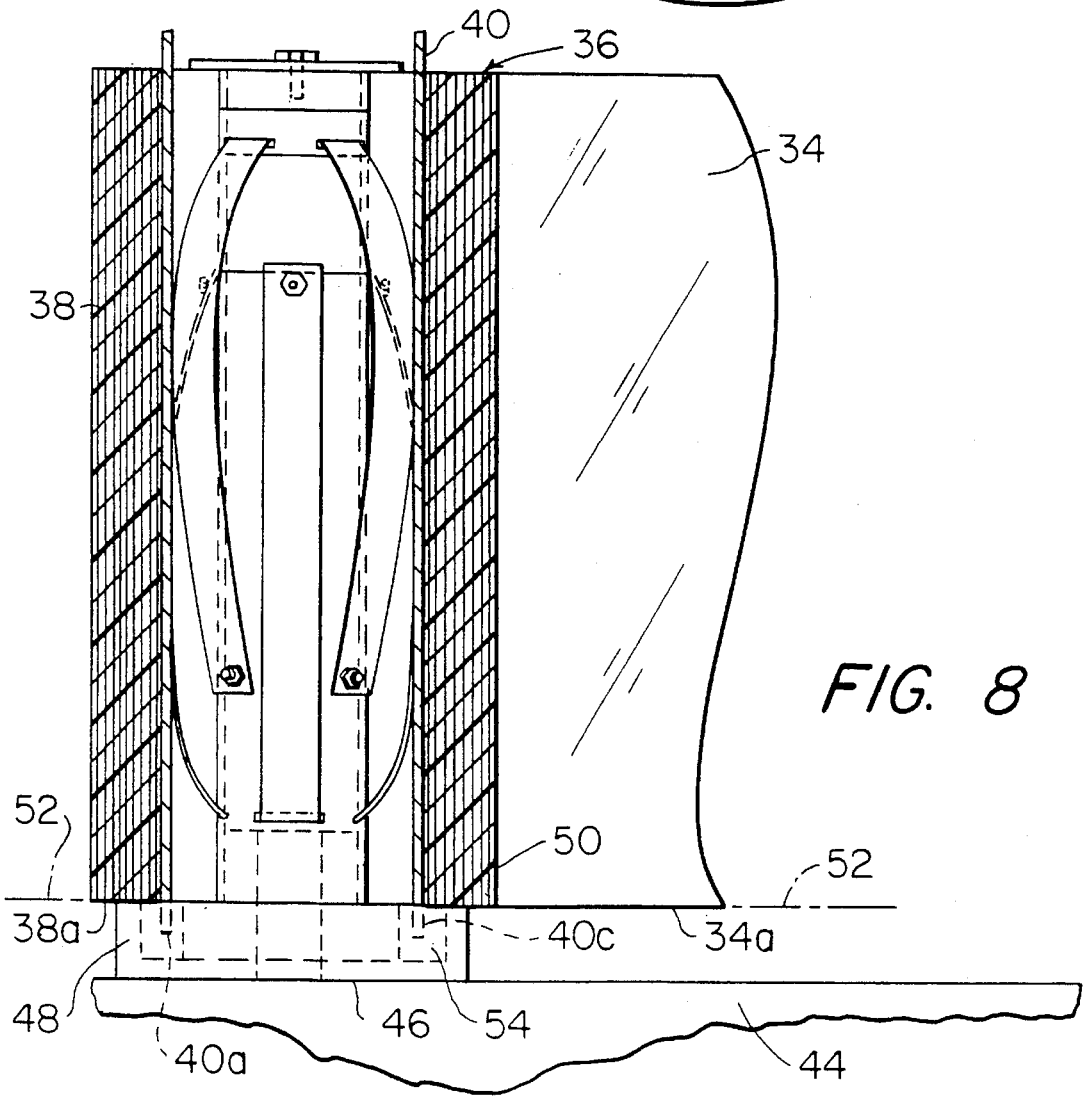
FIG. 8 is a side view of an alternative embodiment of the support with roll of stretch wrap packaging material.

As shown in FIGS. 2, 3 and 8, the support 46 includes an indexing portion 48 with an outer radial area 50 for contacting and indexing one axial end 38*a* of the stretch wrap packaging material 38 at a predetermined axial position 52, shown in FIG. 8. The support 46 also includes an inner radial area 54 which is an open space for permitting any portion 40*c* of the core 40 that extends beyond the one axial end 38*a* of the roll 36 of stretch wrap packaging material 38 to extend beyond the predetermined axial position 52.

The invention provides a space or a displaceable area on the reference plane of predetermined axial position 52 at the radial location of the core between a central area, such as post 62, and the outer radial area 50 of indexing portion 52 which contacts the stretch wrap packaging material 38.

Thus, the indexing portion 48 of the support 46 permits one side 34*a* of the sheet 34 of stretch wrap packaging material 38 to always be indexed and dispensed at the reference plane of the predetermined axial position 52 regardless of how far the portion 40*c* of the core extends beyond the axial end 38*a* of the roll 36 of stretch wrap packaging material. This is useful because core portions of various film rolls may extend various unpredictable distances from the axial ends of their respective stretch wrap packaging material.

Figure 5:
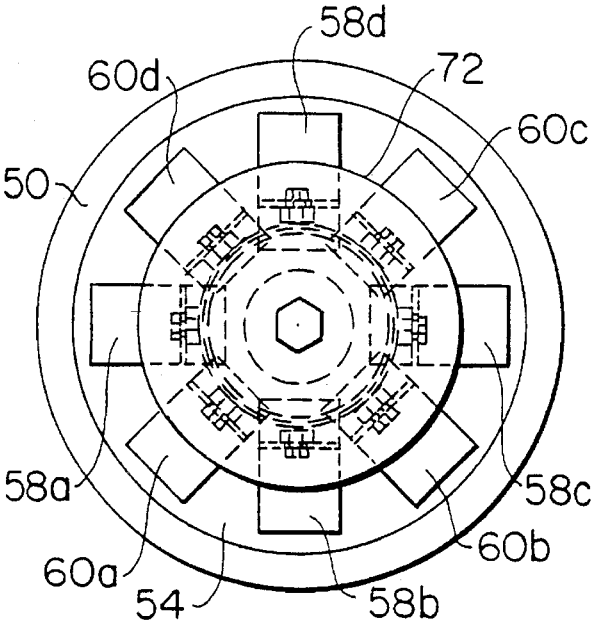
FIG. 5 is a top view of the support shown in FIG. 2.

The support also preferably includes a retaining portion 56 extending within the core 40 for preventing axial movement of the core relative to the support 46 when the outside layer of the stretch wrap packaging material 38 on the roll 36 is disposed radially inward of the outer radial area 50 of the indexing portion 48. As shown in FIGS. 2, 3, and 5, the retaining portion 56 preferably includes a plurality of leaf springs 58 and 60 which are positioned on a post 62.

One set of leaf springs 58 is located at a plurality of angular positions around the top half of the post, and as shown, includes four leaf springs positioned 90° from each other. The leaf springs 58 each includes end portions **58*e* and a middle portion 58*m* which bows outward from the end portions 58*e*. One end 58*e* is fastened to the post 62 with a rivet, or a screw 64 and nut 65, and the other end 58*e* is positioned in a slot 66 in the post 62**.

The second set of leaf springs 60 is similarly arranged at the lower portion of the post 62. With one set of leaf springs 58 at the upper portion of the post 62 and another set of leaf springs located at the lower portion of the post 62, leaf springs are located at a plurality of axial positions to provide stability to the film roll 36. In addition, the second set of leaf springs 60 is positioned at an angular orientation which is not aligned with the first set of leaf springs 58.

The upper end of the post 62 is fitted with a plug 68 that holds the upper ends **58*e* of the leaf springs 58 in place. Similarly, the support 46 includes a plug portion 70 which fits on the lower end of the post 62 to stabilize the post and hold the ends 60*e* of the leaf springs 60 in place. A cap 72 is secured to the plug 68 by a screw 74. An alternative arrangement of almost entirely overlapping leaf springs is shown in FIG. 8**. While leaf springs are currently the preferred embodiment of the retaining portion for preventing axial movement of the core relative to the support, other mechanisms may also be used.

Figure 6:
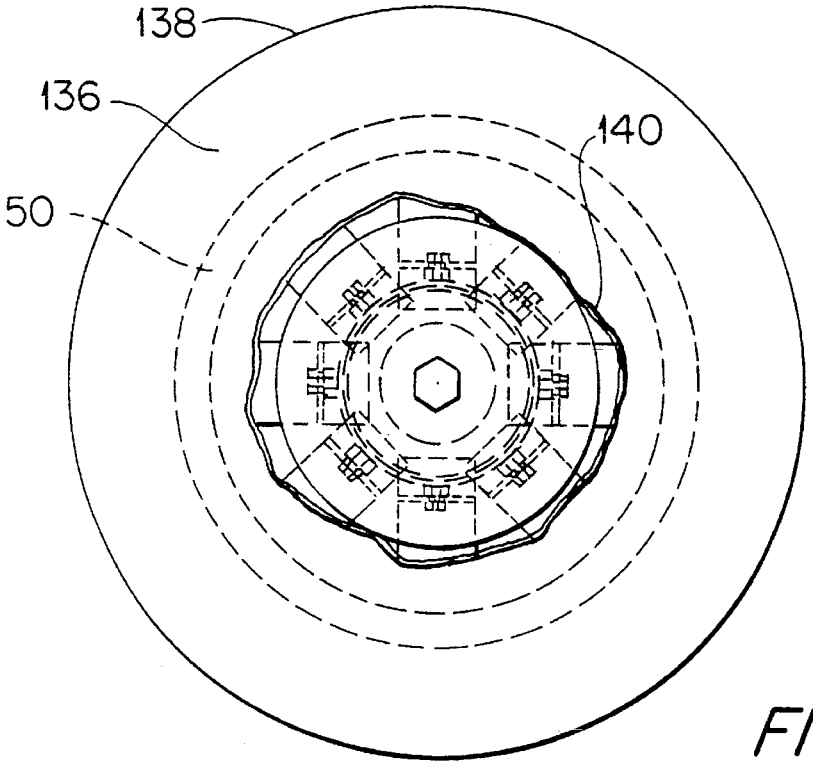
FIG. 6 is a top view of the support shown in FIG. 2 with a large diameter film roll having a small diameter irregular core.
Figure 7:
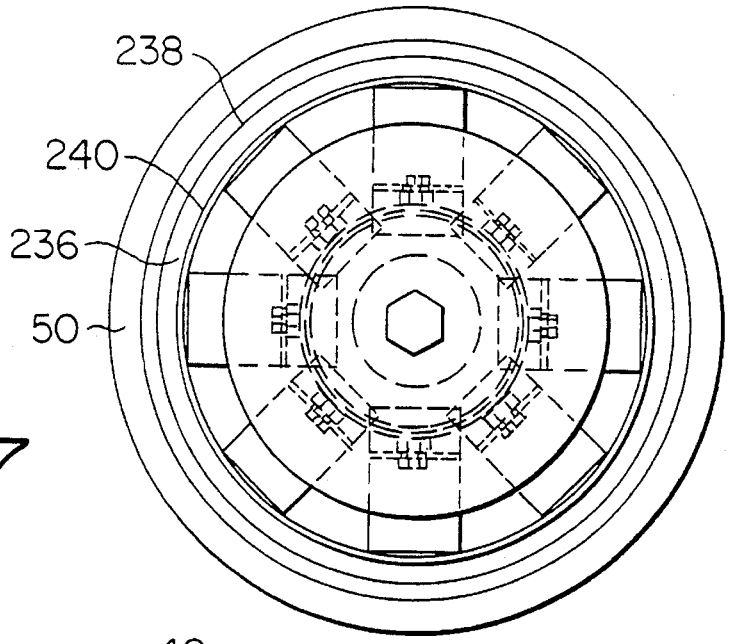
FIG. 7 is a top view of the support shown in FIG. 2 with a small diameter film roll having a large diameter regular core.

The retaining portion 56 preferably biases the core in the radial direction and is flexible and moveable. As shown in FIGS. 6 and 7, the springs 58 and 60 of the retaining portion 56 can thus conform to and retain cores 140 and 240, respectively, having various diameters, such as three or three and one half inches. It also permits the retaining portion 56 to conform to and retain cores having varying diameters, such as core 140 in FIG. 6, which has been crushed or deformed in some places.

The retaining portion 56 also preferably prevents angular movement of the core relative to the support 46. While support 46 permits the roll 36 to rotate relative to the dispenser 44 on which the support 46 is mounted, the retaining portion 56 prevents relative rotation or angular movement of the core 40 relative to the support 46. The rotation of the support 46 in dispenser 44 can be restrained by a frictional mount or a brake which maintains a generally constant tension on the portion of the film 34 that extends between the roll 36 and a prestretch device 78, or between the roll 36 and the load 32 if a prestretch device is not used in the dispenser 44.

FIG. 6 shows a film roll 36 in which the outer circumference 138 of stretch wrap packaging material on the roll 136 extends over and outward of the outer radial area 50 of the support 46. In contrast to FIG. 6, FIG. 7 shows the film roll 36 after it has been depleted to the point where the outer circumference 238 of stretch wrap packaging material on the roll 236 is radially inward of the outer radial area 50 of the indexing portion 48. In the situation shown in FIG. 7, the stretch wrap packaging material is no longer indexed by the outer radial area 50, but is prevented from moving axially by the engagement of the leaf springs 58 and 60 of the retaining portion 56 which are positioned on the inside of the core 240.

Additional advantages and modifications will readily occur to those skilled in the art. The invention in its broader aspect is, therefore, not limited to the specific details, representative apparatus and illustrative examples shown and described. Accordingly, departures may be made from such details without departing from the spirit or scope of the general inventive concepts as defined by the appended claims and their equivalents.

What is claimed is:

1. An apparatus for stretch wrapping a load with a sheet of stretch wrap packaging material which is dispensed from an axially extending roll, the roll including an outer radial portion including stretch wrap packaging material having two axial ends and an inner radial portion including an axially extending core having two axial ends, comprising:

a dispenser for dispensing and stretching the sheet of stretch wrap packaging material, the dispenser including a support for the roll of stretch wrap packaging material and the core which permits the roll to rotate, the support having an indexing position with an outer radial area for contacting and indexing one axial end of the outer radial portion of the roll at a predetermined axial position and an inner radial area for permitting any portion of the core that extends beyond the one axial end of the roll of stretch wrap packaging material to extend beyond the predetermined axial position; and means for providing relative rotation between the dispenser and the load to wrap the stretched sheet around the load.

2. The apparatus of claim 1, wherein the support includes a retaining portion extending inside the core for preventing axial movement of the core relative to the support when the outermost stretch wrap packaging material on the roll is radially inward of the outer radial area of the indexing portion.

3. The apparatus of claim 2, wherein the retaining portion biases the core in the radial direction.

4. The apparatus of claim 2, wherein the retaining portion includes a plurality of leaf springs located at a plurality of angular positions.

5. The apparatus of claim 4, wherein each of the leaf springs includes two end portions and a middle portion which bows outward from the end portions.

6. The apparatus of claim 2, wherein the retaining portion conforms to and retains cores having varying diameters.

7. The apparatus of claim 2, wherein the retaining portion conforms to and retains various diameter cores.

8. The apparatus of claim 1, wherein the support includes a retaining portion extending inside the core for preventing angular movement of the core relative to the support.

9. The apparatus of claim 8, wherein the retaining portion biases the core in the radial direction.

10. The apparatus of claim 8, wherein the retaining portion includes a plurality of leaf springs located at a plurality of angular positions.

11. The apparatus of claim 10, wherein each of the leaf springs includes two end portions and a middle portion which bows outward from the end portions.

12. The apparatus of claim 8, wherein the retaining portion conforms to and retains cores having varying diameters.

13. The apparatus of claim 8, wherein the retaining portion conforms to and retains various diameter cores.

14. The apparatus of claims 10, wherein the retaining portion includes a plurality of leaf springs located at plurality of axial positions.

15. A dispenser for dispensing and stretching a sheet of stretch wrap packaging material which is dispensed from an axially extending roll, the roll including an outer radial portion including stretch wrap packaging material having two axial ends and an inner radial portion including an axially extending core having two axial ends, comprising:

a support for the roll of stretch wrap packaging material and the core which permits the roll to rotate, the support having an indexing portion with an outer radial area for contacting and indexing one axial end of the outer radial portion of the roll at a predetermined axial position and an inner radial area for permitting any portion of the core that extends beyond the one axial end of the roll of stretch wrap packaging material to extend beyond the predetermined axial position.

16. The apparatus of claim 15, wherein the support includes a retaining portion extending inside the core for preventing axial movement of the core relative to the support when the outermost stretch wrap packaging material on the roll is radially inward of the outer radial area of the indexing portion.

17. The apparatus of claim 16, wherein the retaining portion biases the core in the radial direction.

18. The apparatus of claim 16, wherein the retaining portion includes a plurality of leaf springs located at a plurality of angular positions.

19. The apparatus of claim 18, wherein each of the leaf springs includes two end portions and a middle portion which bows outward from the end portions.

20. The apparatus of claim 16, wherein the retaining portion conforms to and retains cores having varying diameters.

21. The apparatus of claim 16, wherein the retaining portion conforms to and retains various diameter cores.

22. The apparatus of claim 15, wherein the support includes a retaining portion extending inside the core for preventing angular movement of the core relative to the support.

23. The apparatus of claim 22, wherein the retaining portion biases the core in the radial direction.

24. The apparatus of claim 22, wherein the retaining portion includes a plurality of leaf springs located at a plurality of angular positions.

25. The apparatus of claim 24, wherein each of the leaf springs includes two end portions and a middle portion which bows outward from the end portions.

26. The apparatus of claim 22, wherein the retaining portion conforms to and retains cores having varying diameters.

27. The apparatus of claim 22, wherein the retaining portion conforms to and retains various diameter cores.

28. The apparatus of claim 24, wherein the retaining portion includes a plurality of leaf springs located at plurality of axial positions.

* * * * *